US005454416A

United States Patent [19]

Ota et al.

[11] Patent Number: 5,454,416

[45] Date of Patent: Oct. 3, 1995

[54] VACUUM CASTING APPARATUS

[75] Inventors: Atushi Ota, Toyota; Yasuyuki Arakawa; Tamotsu Hasegawa, both of Nagoya, all of Japan

[73] Assignee: Toyota Jidosha Kabushiki Kaisha, Toyota, Japan

[21] Appl. No.: 266,780

[22] Filed: Jun. 29, 1994

[30] Foreign Application Priority Data

Jun. 30, 1993 [JP] Japan ..... 5-161193

[51] Int. Cl.[6] ..... B22D 18/02; B22D 18/04

[52] U.S. Cl. ..... 164/254; 164/306; 164/319

[58] Field of Search ..... 164/63, 119, 120, 164/254, 306, 309, 319

[56] References Cited

FOREIGN PATENT DOCUMENTS

| | | | |
|---|---|---|---|
| 0559920 | 9/1993 | European Pat. Off. . | |
| 1331641 | 5/1963 | France . | |
| 61-182868 | 8/1986 | Japan . | |
| 2-155557 | 6/1990 | Japan . | |
| 2-229660 | 9/1990 | Japan | 164/120 |
| 3-31058 | 3/1991 | Japan . | |
| 3-68955 | 7/1991 | Japan . | |
| 3-198969 | 8/1991 | Japan . | |
| 4-158968 | 6/1992 | Japan . | |
| 4-274860 | 9/1992 | Japan . | |
| 5-123845 | 5/1993 | Japan . | |
| 5-146865 | 6/1993 | Japan . | |
| 5-146863 | 6/1993 | Japan . | |
| 5-146864 | 6/1993 | Japan . | |
| 5-169232 | 7/1993 | Japan . | |
| 5-63264 | 9/1993 | Japan . | |

OTHER PUBLICATIONS

Abstract of Japan vol. 17, No. 618 Re: JP–A–05–192 759 Published Aug. 3, 1993.

*Primary Examiner*—J. Reed Batten, Jr.
*Attorney, Agent, or Firm*—Cushman, Darby & Cushman

[57] ABSTRACT

A vacuum casting apparatus in which a molding cavity is reduced in pressure substantially to a vacuum, and upon opening a gate, a molten metal which has been raised to a molten metal retaining dome is charged into the molding cavity via a runner at a high speed. The runner has a first portion making a pool of molten metal, a second portion connecting the molten metal retaining dome to the first portion, and a third portion connecting the first portion to the molding cavity. A pin is slidably provided in the first portion of the runner. An opening of the second portion of the runner to the first portion is located nearer to the pin than an opening of the third portion of the runner to the first portion. When the pin is moved into the first portion of the runner, the pin first closes the opening of the second portion and then begins to apply pressure the molten metal in the molding cavity.

10 Claims, 2 Drawing Sheets

VACUUM CASTING APPARATUS

BACKGROUND OF THE INVENTION

1. Field of the Invention

The present invention relates to a vacuum casting apparatus in which a molding cavity is reduced in pressure substantially to a vacuum and upon opening a gate, a molten metal is charged into the molding cavity at a high speed due to the resultant pressure difference.

2. Description of Related Art

As one example of a casting apparatus capable of casting products of a high quality and a low cost, a vacuum casting apparatus (named by the present applicant as a Vacuum Precharged Closed squeezed casting apparatus) was proposed by the present applicant in Japanese Patent Publication HEI 2-155557.

The proposed casting apparatus includes a molding cavity which can be reduced in pressure substantially to a vacuum, a molten metal supply passage, a gate piston for opening and shutting a passage communicating the molding cavity with the molten metal supply passage, and a pressure pin assembled in the gate piston. In the proposed casting apparatus, the molding cavity is reduced in pressure to a vacuum. Then, the gate piston is opened to charge a molten metal from the molten metal supply passage into the molding cavity at a high speed. The gate piston is then closed to shut the molding cavity filled with the molten metal, and the pressure pin is operated to pressurize the molten metal in the molding cavity before the molten metal solidifies. In this apparatus, since the molding cavity is at a vacuum, the mixing of air in the molten metal is prevented, so that casting defects due to bubbles in the metal are avoided. Further, since the charging speed is high, running of the molten metal in the molding cavity is improved and the production of slimmer cast products is made possible.

However, the following problems yet remain with the above-described vacuum casting apparatus:

First, since the mechanism for shutting the molding cavity from the molten metal supply passage and the mechanism for pressurizing the molten metal in the molding cavity are separate from each other, provision of both mechanisms is accompanied by a restriction in space for providing both mechanisms, an increase in cost, and complication of structure.

Second, since the gate piston shutting process is not followed by the pressurizing process in a continuous fashion, it is difficult to properly determine the timing for initiating the pressurizing step appropriately. For example, if the pressurizing is initiated too early, the pressure pin would operate before the molding cavity was shut so that pressurization would be impossible. On the other hand, if the pressurization is initiated too late, the molten metal would begin to solidify before the pressurization, so that molding defects would be generated.

SUMMARY OF THE INVENTION

An object of the present invention is to provide a vacuum casting apparatus wherein shutting off a molding cavity and pressurizing a molten metal in the molding cavity is conducted by a single mechanism, and further wherein a shutting process is continuously followed by a pressurizing process.

The above-described object is achieved by a vacuum casting apparatus in accordance with the present invention which includes: a molding cavity in which pressure can be reduced substantially to a vacuum, a molten metal retaining dome for temporarily retaining the molten metal raised from a molten metal holding furnace, a runner for connecting the molten metal retaining dome to the molding cavity, and a gate allowing the molten metal in the molten metal retaining dome to flow into the molding cavity in a vacuum through the runner upon opening the gate, wherein a first portion for making a pool of molten metal is formed in the runner. The runner further includes a second portion connecting the molten metal retaining dome to the first portion of the runner and a third portion connecting the first portion of the runner to the molding cavity. A pin is provided to the first portion of the runner so that the pin can pressurize a molten metal in the molding cavity via the first portion and the third portion of the runner. An opening of the second portion of the runner to the first portion of the runner is positioned nearer to the pin than an opening of the third portion of the runner to the first portion of the runner.

Preferably, the first portion of the runner has a circular transverse cross section, and the second portion of the runner extends tangentially to the first portion of the runner.

In the above-described vacuum casting apparatus of the present invention, when the pin is moved into the first portion of the runner, the pin firstly shuts the opening of the second portion of the runner to isolate the molding cavity from the molten metal retaining dome. When the pin is further moved into the first portion of the runner, the pin begins pressurizing the molten metal in the molding cavity via the first portion and the third portion of the runner. Thus, the pin functions as a shut-off pin for shutting off the molding cavity from the molten metal retaining dome as well as a pressure pin for pressuring the molten metal in the molding cavity. As a results shutting the molding cavity and pressurizing the molten metal in the molding cavity are conducted by a single mechanism which includes the pin slidably movable with first portion of the runner. Further, since the pin begins pressurizing the molten metal upon having shut off the opening of the second portion of the runner, the shutting off process is continuously followed by the pressurizing process, so that there is no difficulty in determining a proper timing for beginning the pressurizing.

In the case where the second portion of the runner extends tangentially with the first portion of the runner, the molten metal of a high temperature and a high speed flowing from the second portion into the first portion does not attack the opposed opening of the third portion of the runner to the first portion, so that local melting of the casting die is prevented. Further, the molten metal will generate a spiral, laminar flow in the first portion of the runner, so generation of turbulent flows in the molten metal will be suppressed in the first portion.

BRIEF DESCRIPTION OF THE DRAWINGS

The above and other objects, features, and advantages of the present invention will become more apparent and will be more readily appreciated from the following detailed description of the preferred embodiments of the present invention taken in conjunction with the accompanying drawings, in which.

Figure 1:
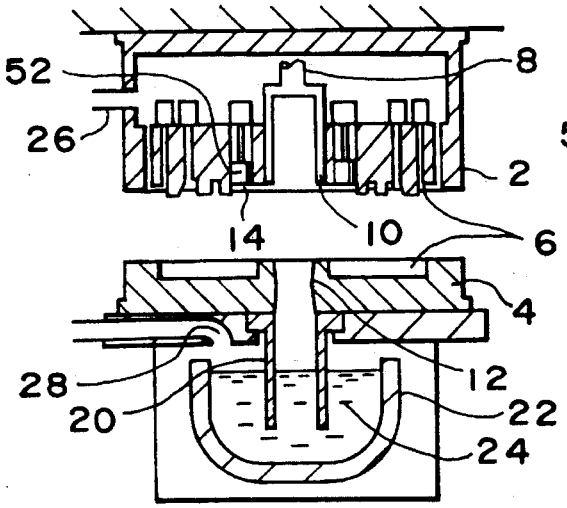
FIG. 1 is a cross-sectional view of a casting apparatus in accordance with the present invention in a state where the molding dies are open.
Figure 3:
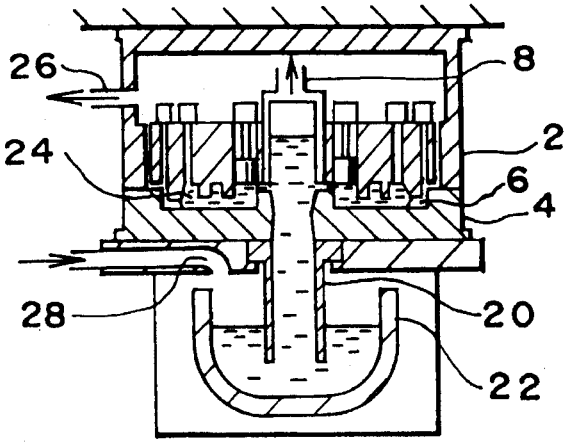
Figure 4:
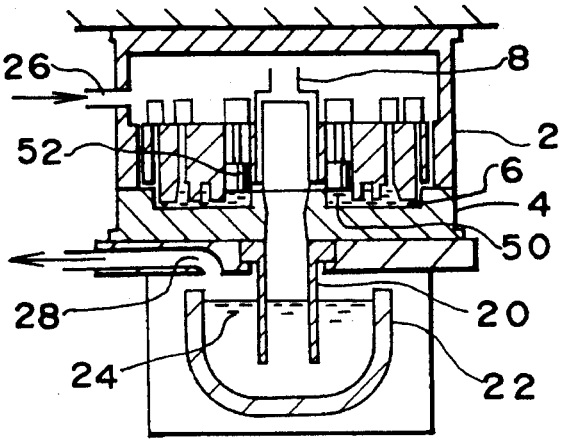
Figure 5:
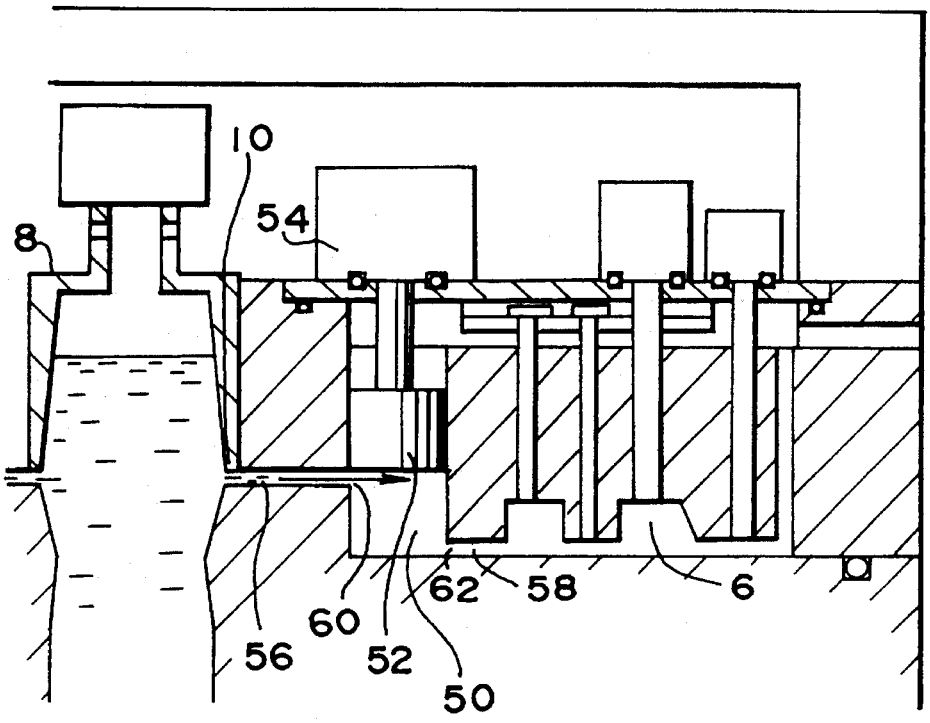
Figure 6:
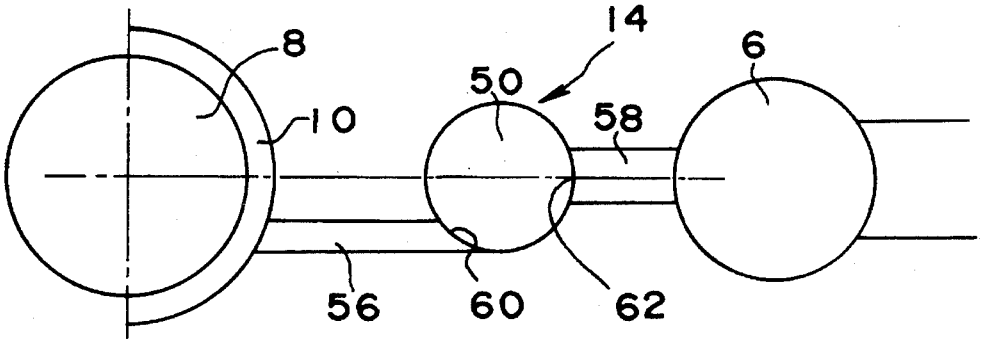
Figure 7:
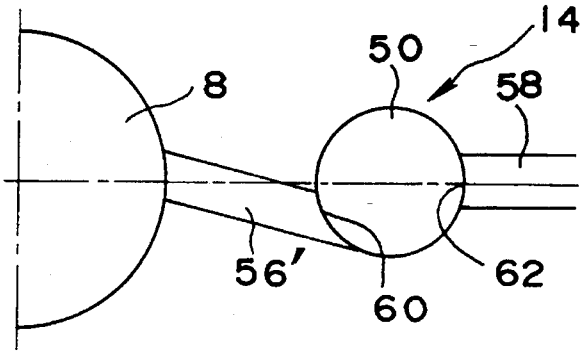

1 in a state where the dies have been closed and a molding cavity has been reduced in pressure;

FIG. 3 is a cross-sectional view of the apparatus of FIG. 1 in a state where a molten metal is charged into the molding cavity;

FIG. 4 is a cross-sectional view of the apparatus of FIG. 1 in a state where the molding cavity has been closed and a pin is operated;

FIG. 5 is an enlarged, partial cross-sectional view of a runner portion of the casting apparatus in accordance with FIG. 1;

FIG. 6 is a plan view of a runner of a casting apparatus in accordance with a first embodiment of the present invention; and FIG. 7 is a plan view of a runner of a casting apparatus in accordance with a second embodiment of the present invention.

DETAILED DESCRIPTION OF THE PREFERRED EMBODIMENTS

FIGS. 1–5 illustrate structures common to all the embodiments of the present invention. FIG. 6 and FIG. 7 illustrate runner structures specific to the first and second embodiments of the present invention, respectively. Throughout all the embodiments of the present invention, portions having the same or similar structures are denoted with the same reference numerals.

First, structures and operation common to all the embodiments of the present invention will be explained with reference to FIGS. 1–5.

A vacuum casting apparatus does not have a molten metal injection mechanism which the conventional high pressure casting apparatus or the conventional die casting apparatus has. Thus, the apparatus of the present invention is much simpler than those conventional apparatuses. Compared with the conventional low pressure casting apparatus, the vacuum casting apparatus of the present invention is provided with a gate for shutting off the molding cavity and a pressure reducing mechanism for reducing the pressure in the molding cavity, so that the molding cavity can be charged with a molten metal at a high speed using a pressure difference between the vacuum generated in the molding cavity and the atmospheric pressure retained in the molten metal retaining dome.

More particularly, a molding die assembly which includes an upper die 2 and a lower die 4 is capable of being opened and closed by moving the upper die 2 relative to the lower die 4 in a vertical direction. The upper die 2 and the lower die 4 define at least one molding cavity 6 therebetween. In the embodiment illustrated in FIGS. 1–4, a plurality of molding cavities 6 are arranged around a molten metal retaining dome 8, which is located at a central portion of the molding die assembly, and extend radially therefrom. The molding cavity 6 can be shut off or be isolated from the interior of the molten metal retaining dome 8 by a gate 10 which is formed at a lower end of the molten metal retaining dome 8. The molding cavity 6 is connected to a pressure reducing pump (not shown) via a suction port 26 and can be reduced in pressure to a vacuum after the molding die assembly is closed and the molding cavity 6 is shut off by the gate 10.

Figure 2:
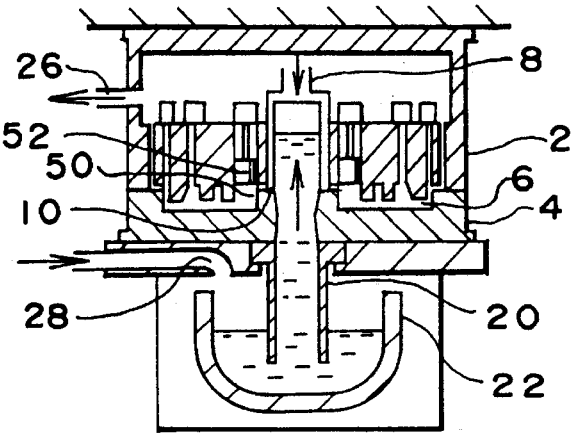
FIG. 2 is a cross-sectional view of the apparatus of FIG.

The molten metal retaining dome 8 communicates with a molten metal holding furnace 22 via a sprue 12 formed in the lower die 4 and a stalk 20 connecting the sprue 12 to the molten metal holding furnace 22. The molten metal holding furnace 22 is housed in a closed chamber, and a pressure of an interior of the closed chamber can be controlled by a pressure pump (not shown) connected to the closed chamber via a pressure port 28. When the pressure of the interior of the closed chamber is increased and the increased pressure acts on a free surface of the molten metal 24 (for example, molten aluminum alloy) held in the molten metal holding furnace 22, a portion of the molten metal 24 held in the molten metal holding furnace 22 is raised into the molten metal retaining dome 8, as illustrated in FIG. 2.

The molten metal retaining dome 8 is connected to the molding cavity 6 via at least one runner 14. Each runner 14 includes a first portion 50 making a pool of molten metal (a molten metal pool making portion 50), a second portion 56 connecting an interior of the molten metal retaining dome 8 to the first portion 50 of the runner 14, and a third portion 58 connecting the first portion 50 of the runner 14 to the molding cavity 6. A cross-sectional area of the first portion 50 is larger than those of the second portion 56 and the third portion 58 of the runner 14, respectively. The first portion 50 of the runner 14 extends vertically, and the second portion 56 and the third portion 58 of the runner 14 extend horizontally. A cross section of the first portion 50 is preferably circular. A pin 52 having a circular transverse cross section is provided in the first portion 50 of the runner 14 such that the pin 52 is movable relative to the first portion 50 of the runner 14. The pin 52 is moved by a cylinder 54 in an axial direction of the first portion 50 of the runner 14.

The second portion 56 opens to the first portion 50 at an opening 60. Similarly, the third portion 58 opens to the first portion 50 to an opening 62. The opening 60 of the second portion 56 of the runner 14 to the first portion 50 of the runner 14 is positioned nearer to an initial position of the pin 52 than the opening 62 of the third portion 58 of the runner 14 to the first portion 50. In a case where the pin 52 is positioned above the openings 60 and 62 when the molding cavity 6 is in communication with the molten metal retaining dome 8, the opening 60 is positioned above the opening 62. When the pin 52 is moved toward openings 60 and 62, the opening 60 is first shut by the pin 52. When the opening 60 has been shut by the pin 52, the molten metal in the molding cavity 6 is isolated from the molten metal retaining dome 8. When the pin 52 is further moved into the first portion 50 of the runner 14, the molten metal in the first portion 50, the third portion 58, and the molding cavity 6 can be pressurized by the pin 52. Since the pin 52 operates as a pressure pin as well as a shut-off pin, the number of other pressure pins can be reduced. Since pressurization of the molten metal by the pin 52 begins upon shutting the opening 60 by the pin 52, the shutting process is continuously followed by the pressurizing process. Thus, the pressurization beginning timing is automatically determined.

Preferably, the second portion 56 of the runner 14 extends tangentially or at an offset to the first portion 50 of the runner 14, so that when the molten metal flows into the first portion 50, the molten metal does not directly impinge upon the opposed opening 62 of the third portion 58. Direct attack could actually melt a portion of the die defining the opening 62. Further, the molten metal which tangentially flows into the first portion 50 of the runner 14 generates a laminar, spiral flow in the first portion 50 of the runner 14, so no serious turbulent flow is generated in the first portion 50. Thus, flow of the molten metal into the molding cavity 6 will be advantageously smooth.

Structures specific to each embodiment of the present invention will now be explained.

In the first embodiment of the invention, as illustrated in FIG. 6, the second portion 56 of the runner 14 extends in a direction parallel to the third portion 58 of the runner 14, though the second portion 56 and the third portion 58 of the runner 14 are offset from each other in a direction perpendicular to the runner 14.

In the second embodiment of the invention, as illustrated in FIG. 7, the second portion 56 of the runner 14 obliquely crosses an extension of the third portion 58 of the runner 14. The extension of the third portion 58 passes through a center of the first portion 50 of the runner 14.

Using the above-described apparatus, a vacuum casting of the present invention is conducted as follows:

First, the molding die assembly is closed, by which the state of the casting apparatus shown in FIG. 1 is changed to a state shown in FIG. 2. Then, the molten metal retaining dome 8 is lowered relative to the upper die 2, so that the gate 10 isolates the molding cavity 6 from the interior of the molten metal retaining dome 8 which communicates with atmosphere. Then, the molding cavity 6 is reduced in pressure to a vacuum by operating the pressure reducing pump connected to molding cavity 6 via the suction port 26 (as indicated by the arrow at 26 in FIG. 2). The vacuum to be generated in the molding cavity 6 is higher than about 50 torr, and preferably higher than about 20 torr, and most preferably about 10 torr. Because a vacuum of 50–100 torr is used in the conventional vacuum die casting, the vacuum casting of the present invention can be distinguished from the conventional vacuum die casting. Casting products having a high quality as that of the conventional vacuum die casting can be obtained at a higher vacuum than 20 torr in the casting of the present invention. Substantially simultaneously with reduction of the pressure in the molding cavity 6, the pressure acting on the free surface of the molten metal held in the molten metal holding furnace 22 is increased so that a portion of the molten metal 24 held in the furnace 22 is raised into the molten metal retaining dome 8 via stalk 20. The rising speed of an upper surface of the molten metal in the molten metal retaining dome 8 is about 5–10 cm/sec. When the increase in the gas pressure acting on the molten metal held in the furnace 22 is stopped, the upper surface of the molten metal in the molten metal retaining dome 8 may oscillate vertically for a few seconds due to a cushion effect of the gas inside the closed chamber in which the furnace 22 is housed.

Then, as illustrated in FIG. 3, the gate 10 is opened so that the molten metal 24 in the molten metal retaining dome 8 is charged into the molding cavity 6 at relatively a high speed due to the pressure difference between the vacuum in the molding cavity 6 and the atmospheric pressure retained inside the molten metal retaining dome 8. The charging speed of the molten metal running in the molding cavity 6 is about 7 m/sec. This speed is much higher than the charging speed of molten metal in the conventional low casting which is about 0.5 m/sec. This high charging speed improves the running characteristic of molten metal in the molding cavity and allows thinner cast products to be formed. Though such a high speed is obtained in conventional die casting, the molten metal tends to have bubbles mixed in, and also, a hydraulic cylinder needs to be provided in conventional die casting. In contrast, in the vacuum casting of the present invention, no bubbles are mixed in the molten metal charged into the molding cavity, due to the vacuum generated in the molding cavity 6, so little or no casting defects are generated.

When the molten metal of high temperatures flows from the second portion 56 of the runner into the first portion 50, the molten metal flows tangentially thereinto with respect to the circular cross section of the first portion 50. Thus, the molten metal does not directly impinge upon the opposed opening 62 of the third portion 58 so the wall surface around the opening 62 is protected from being damaged or melted by the molten metal. Further, since the molten metal spirally flows along the wall surface of the first portion 50 in a state of a laminar flow, the molten metal does not tend to generate turbulent flows in the first portion 50 and can flow smoothly into the molding cavity 6.

Then, as illustrated in FIG. 4, the pin 52 is lowered to shut off the runner 14, so that the molding cavity 6 filled with the molten metal is closed and also pressurized. More particularly, as illustrated in FIG. 5, the pin 52 is movable relative to the first portion 50 in an axial direction of the first portion 50. When the molten metal has been charged from the molten metal retaining dome 8 into the molding cavity 6, the pin 52 is moved by a cylinder 54 to first close the first opening portion 60 and shut off the molten metal in the molding cavity 6 from the molten metal retaining dome 8. When the pin 52 has closed the opening 60 and is further moved into the first portion 50, the molten metal in the first portion 50 of the runner 14, in the third portion 58 of the runner 14, and in the molding cavity 6 is pressurized. Thus, the pin 52 functions as a shut-off pin and also as a pressure pin. Accordingly, pressure pins which are conventionally provided to the molding cavity 6 need not be provided or can be reduced in number in the apparatus of the present invention, and the closing and pressurizing mechanism of the present invention is made advantageously simple.

Further, since the pin 52 begins pressurizing the molten metal in the molding cavity 6 simultaneously with closing the first opening portion 60, the pressurizing motion is continuously followed by the closing motion. As a result, a timing for pressurizing the molten metal in the molding cavity 6 is automatically determined and the determination of the timing is much easier than that of the conventional casting process.

Then, as illustrated in FIG. 4, the molten metal in the molding cavity 6 is cooled naturally or forcibly. While the molten metal is cooled, the gas pressure acting on the molten metal held in the molten metal holding furnace 22 is released, and also the vacuum pressure generated in the molding cavity is released. After the molten metal has solidified, the molding die is opened, and the cast product is taken out from the molding die. The inside surface of the molding die defining the molding cavity 6 can be then coated with a mold release agent and is prepared for the next molding cycle.

According to the present invention, the following advantages will be obtained:

Since a first portion for making a pool of molten metal is formed in the runner and a pin is provided in the first portion of the runner, a mechanism for closing the runner and a mechanism for pressurizing a molten metal charged into the molding cavity are constructed as a single mechanism. As a result, the mechanism is simplified. Further, the shutting off process can be continuously followed by the pressurizing process, and as a result, determining when to start pressurization is also simplified.

Since the second portion of the runner extends tangentially to the first portion of the runner, the molten metal does not directly impinge the opposed opening of the third portion of the runner directly. As a result, the portion of the casting die around the opening of the third portion of the runner is protected from being damaged or melted by the molten metal. Further, since the molten metal flows in a state of a laminar flow, the molten metal can smoothly flow into the molding cavity.

Although only a few embodiments of the present invention have been described in detail above, it will be appreciated by those skilled in the art that various modifications and alterations can be made to the particular embodiments shown without materially departing from the novel teachings and advantages of the present invention. Accordingly, it is to be understood that all such modifications and alterations are included within the spirit and scope of the present invention as defined by the following claims.

What is claimed is:

1. A vacuum casting apparatus comprising:

means for defining a molding cavity which can maintain a vacuum therein;

means for creating a vacuum in said molding cavity; a molten metal holding furnace for holding a molten metal;

a molten metal retaining dome disposed above said molten metal holding furnace and in communication with the molten metal in said molten metal holding furnace;

a runner providing a molten metal path between said retaining dome and said molding cavity, said runner including:

a first portion for holding a pool of molten metal;

a second portion connecting the interior of said retaining dome with said first portion;

a third portion connecting said first portion and said molding cavity; and a pressurizing pin slidably provided in said first portion which operates to place molten metal in said first portion under pressure, said pin moving in operation from a first position to a second position, wherein said second portion opens onto said first portion at a first opening and said third portion opens onto said first portion at a second opening, said first opening and said second opening being spaced apart such that as said pressurizing pin moves towards said second position it blocks said first opening before blocking said second opening; and a selectively openable gate between said retaining dome and said molding cavity for selectively permitting said molten metal to be charged into said molding cavity from the retaining dome.

2. A vacuum casting apparatus according to claim 1, wherein said pin is movable vertically in said first portion and wherein said first position of said pin is located above said second portion and said third portion of said runner, and said second portion of said runner is located above said third portion of said runner.

3. A vacuum casting apparatus according to claim 1, wherein said pin is movable relative to said first portion of said runner axially with said first portion of said runner.

4. A vacuum casting apparatus according to claim 1, further comprising a cylinder for moving said pin.

5. A vacuum casting apparatus according to claim 1, wherein said first portion of said runner extends vertically and said second portion and said third portion of said runner extend horizontally.

6. A vacuum casting apparatus according to claim 1, wherein said first portion of said runner has a circular transverse cross section and said pin has a circular transverse cross section.

7. A vacuum casting apparatus according to claim 1, wherein said pin operates as a shutting pin for shutting said molding cavity from the interior of said molten metal retaining dome and as a pressure pin for pressurizing the molten metal charged into said molding cavity.

8. A vacuum casting apparatus according to claim 1, wherein said second portion extends tangentially from said first portion.

9. A vacuum casting apparatus according to claim 8, wherein said second and third portions are parallel to one another.

10. A vacuum casting apparatus according to claim 8, wherein said second portion extends in a direction oblique to a direction in which said third portion extends.

* * * * *